US011020980B2

(12) United States Patent
Ozawa et al.

(10) Patent No.: US 11,020,980 B2
(45) Date of Patent: Jun. 1, 2021

(54) DROPLET DISCHARGE APPARATUS

(71) Applicant: SEIKO EPSON CORPORATION, Tokyo (JP)

(72) Inventors: Kinya Ozawa, Shiojiri (JP); Takayuki Yokoyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/829,538

(22) Filed: Mar. 25, 2020

(65) Prior Publication Data

US 2020/0307239 A1 Oct. 1, 2020

(30) Foreign Application Priority Data

Mar. 27, 2019 (JP) ..... JP2019-061301

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC .... B41J 2/17566; B41J 2/17596; B41J 2/175; B41J 2/16523; B41J 2/16508
USPC ..... 347/7, 36, 84, 85
See application file for complete search history.

(56) References Cited

U.S. PATENT DOCUMENTS 10,434,779 B2 * 10/2019 Nakamura ..... B41J 2/16526
10,875,319 B2 * 12/2020 Ozawa ..... B41J 2/18
2005/0116970 A1 * 6/2005 Nakazawa ..... B41J 2/1707 347/7

FOREIGN PATENT DOCUMENTS

JP 2013-129081 A 7/2013

* cited by examiner

*Primary Examiner* — An H Do
(74) *Attorney, Agent, or Firm* — Workman Nydegger

(57) ABSTRACT

A droplet-discharge-apparatus includes a first-head, a first-ink-container storing first-ink, a second-head, a second-ink-container storing second-ink, a cleaning-liquid-container storing cleaning-liquid, a common-flow-path-system, a cleaning-liquid-flow-path, a first-pomp feeding the first-ink from the first-ink-container to the second-ink-container through the common-flow-path-system, a second-pomp feeding the cleaning-liquid from the cleaning-liquid-container to the first-ink-container through the cleaning-liquid-flow-path and the common-flow-path-system, a first-valve controlling a liquid flow rate between the common-flow-path-system and the first-ink-container, a second-valve controlling a liquid flow rate between the common-flow-path-system and the second-ink-container, a third-valve controlling a liquid flow rate between the common-flow-path-system and the cleaning-liquid-flow-path, and a control-unit. The control-unit transfers the first-ink from the first-ink-container to the second-ink-container by controlling the first-valve, the second-valve, the third-valve, and the first-pomp, and transfers the cleaning-liquid from the cleaning-liquid-container to the first-ink-container by controlling the first-valve, the second-valve, the third-valve, and the second-pomp.

11 Claims, 9 Drawing Sheets

DROPLET DISCHARGE APPARATUS

The present application is based on, and claims priority from JP Application Serial Number 2019-061301, filed Mar. 27, 2019, the disclosure of which is hereby incorporated by reference herein in its entirety.

BACKGROUND

1. Technical Field

The present disclosure relates to a droplet discharge apparatus.

2. Related Art

The droplet discharge apparatus is an apparatus that discharges liquid droplets from fine nozzles and attaches the liquid droplets to a recording medium. The droplet discharge apparatus has a characteristic to be able to quickly record a high-resolution and high-quality image. In an ink jet recording method using the droplet discharge apparatus, an image is formed by discharging inks of a plurality of colors.

The droplet discharge apparatus is also used for textile printing. The textile printing may be performed by, for example, using an ink set of colors including cyan (C), magenta (M), yellow (Y), black (BK), and the like, and mixing colors and adjusting size and density of dots on the textile. However, a desired color may not be obtained by such adjusting. In such a case, an ink for obtaining a desired color is prepared in advance and the ink may be discharged from the droplet discharge apparatus. Therefore, a droplet discharge apparatus is required where a different color ink or an ink having different components can be replaced so as to be able to use a color other than C, M, Y, and BK.

JP-A-2013-129081 discloses a technique where ink flow paths of Y, M, C, and BK are coupled to one head, and when replacing ink to be supplied to the head, the ink is returned to a liquid storage tank and an empty prevention liquid that prevents a head flow path from being empty is supplied to the head flow path.

However, when ink is to be prepared in advance in the technique described in JP-A-2013-129081, the liquid storage tank is required to be provided for each color. Further, when the amount of ink to be used is large as in a printing field, the size of the tank needs to be large, and waste often occurs in the prepared ink when replacing the ink.

SUMMARY

According to an aspect of the present disclosure, a droplet discharge apparatus includes a first head, a first ink container that stores first ink to be supplied to the first head, a second head, a second ink container that stores second ink to be supplied to the second head, a cleaning liquid container that stores cleaning liquid, a common flow path system that couples the first ink container with the second ink container, a cleaning liquid flow path that couples the common flow path system with the cleaning liquid container, a first valve that controls a liquid flow rate between the common flow path system and the first ink container, a second valve that controls a liquid flow rate between the common flow path system and the second ink container, a third valve that controls a liquid flow rate between the common flow path system and the cleaning liquid flow path, a first pomp that is provided in the common flow path system and feeds the first ink from the first ink container to the second ink container through the common flow path system, a second pomp that feeds the cleaning liquid from the cleaning liquid container to the first ink container through the cleaning liquid flow path and the common flow path system, and a control unit, and the control unit transfers the first ink stored in the first ink container to the second ink container through the common flow path system by controlling the first valve, the second valve, the third valve, and the first pomp, and transfers the cleaning liquid stored in the cleaning liquid container to the first ink container through the cleaning liquid flow path and the common flow path system by controlling the first valve, the second valve, the third valve, and the second pomp.

According to the aspect described above, the droplet discharge apparatus includes a waste liquid container, a waste liquid flow path system that couples the common flow path system with the waste liquid container, a fourth valve that controls a liquid flow rate between the common flow path system and the waste liquid flow path system, and a third pomp that feeds the cleaning liquid transferred to the first ink container from the first ink container to the waste liquid container through the waste liquid flow path system, and the control unit may transfer the cleaning liquid transferred to the first ink container to the waste liquid container through the waste liquid flow path system by controlling the first valve, the fourth valve, and the third pomp.

According to any one of the aspects described above, the droplet discharge apparatus includes a fourth pomp that feeds the cleaning liquid from the cleaning liquid container to the waste liquid container through the cleaning liquid flow path, the common flow path system, and the waste liquid flow path system, and the control unit may transfer the cleaning liquid stored in the cleaning liquid container to the waste liquid container through the cleaning liquid flow path, the common flow path system, and the waste liquid flow path system by controlling the first valve, the second valve, the third valve, the fourth valve, and the fourth pomp.

According to any one of the aspects described above, in the droplet discharge apparatus, the waste liquid container may store liquid discharged from the first head.

According to any one of the aspects described above, the droplet discharge apparatus includes a first flow path system that couples the first head with the first ink container, and a fifth valve provided in the first flow path system, and the control unit may transfer the cleaning liquid transferred to the first ink container to the first head through the first flow path system by controlling the fifth valve.

According to any one of the aspects described above, in the droplet discharge apparatus, the control unit may reduce a liquid flow rate of the first flow path system by controlling the fifth valve when transferring the cleaning liquid stored in the cleaning liquid container to the first ink container through the cleaning liquid flow path and the common flow path system.

According to any one of the aspects described above, in the droplet discharge apparatus, the first flow path system includes a first auxiliary container coupled to the first head, and a fifth pomp provided between the first auxiliary container and the first ink container, and the control unit may collect the first ink stored in the first auxiliary container into the first ink container by controlling the fifth pomp before transferring the first ink stored in the first ink container to the second ink container through the common flow path system.

According to any one of the aspects described above, the droplet discharge apparatus includes a second flow path system that couples the second head with the second ink container, a sixth valve provided in the second flow path system, a first sensor that detects an amount of liquid in the first ink container, a second sensor that detects an amount of liquid in the second ink container, and a second auxiliary container coupled to the second head, and the control unit may transfer the second ink in the second ink container to the second auxiliary container by controlling the sixth valve when a total amount of the amount of liquid in the first ink container detected by the first sensor and the amount of liquid in the second ink container detected by the second sensor exceeds a predetermined amount before transferring the first ink stored in the first ink container to the second ink container through the common flow path system.

According to any one of the aspects described above, the droplet discharge apparatus includes a second flow path system that couples the second head with the second ink container, a sixth valve provided in the second flow path system, a second sensor that detects an amount of liquid in the second ink container, and a second auxiliary container coupled to the second head, and the control unit may transfer the second ink in the second ink container to the second auxiliary container by controlling the sixth valve when the second sensor detects that the amount of liquid in the second ink container exceeds a predetermined amount.

According to any one of the aspects described above, the droplet discharge apparatus includes a first sensor that detects an amount of liquid in the first ink container, and a second sensor that detects an amount of liquid in the second ink container, and the control unit may transfer the first ink stored in the first ink container to the second ink container through the common flow path system when the amount of liquid in the first ink container detected by the first sensor is smaller than the amount of liquid in the second ink container detected by the second sensor.

According to any one of the aspects described above, in the droplet discharge apparatus, the first ink and the second ink may be the same ink.

DESCRIPTION OF EXEMPLARY EMBODIMENTS

Hereinafter, an embodiment of the present disclosure will be described. The embodiment described below describes an example of the present disclosure. The present disclosure is not limited at all by the embodiment described below. The present disclosure includes various modified examples implemented within the scope not changing the gist of the present disclosure. All of the configurations described below are not necessarily essential components of the present disclosure.

1. Configuration of Droplet Discharge Apparatus

Figure 1:
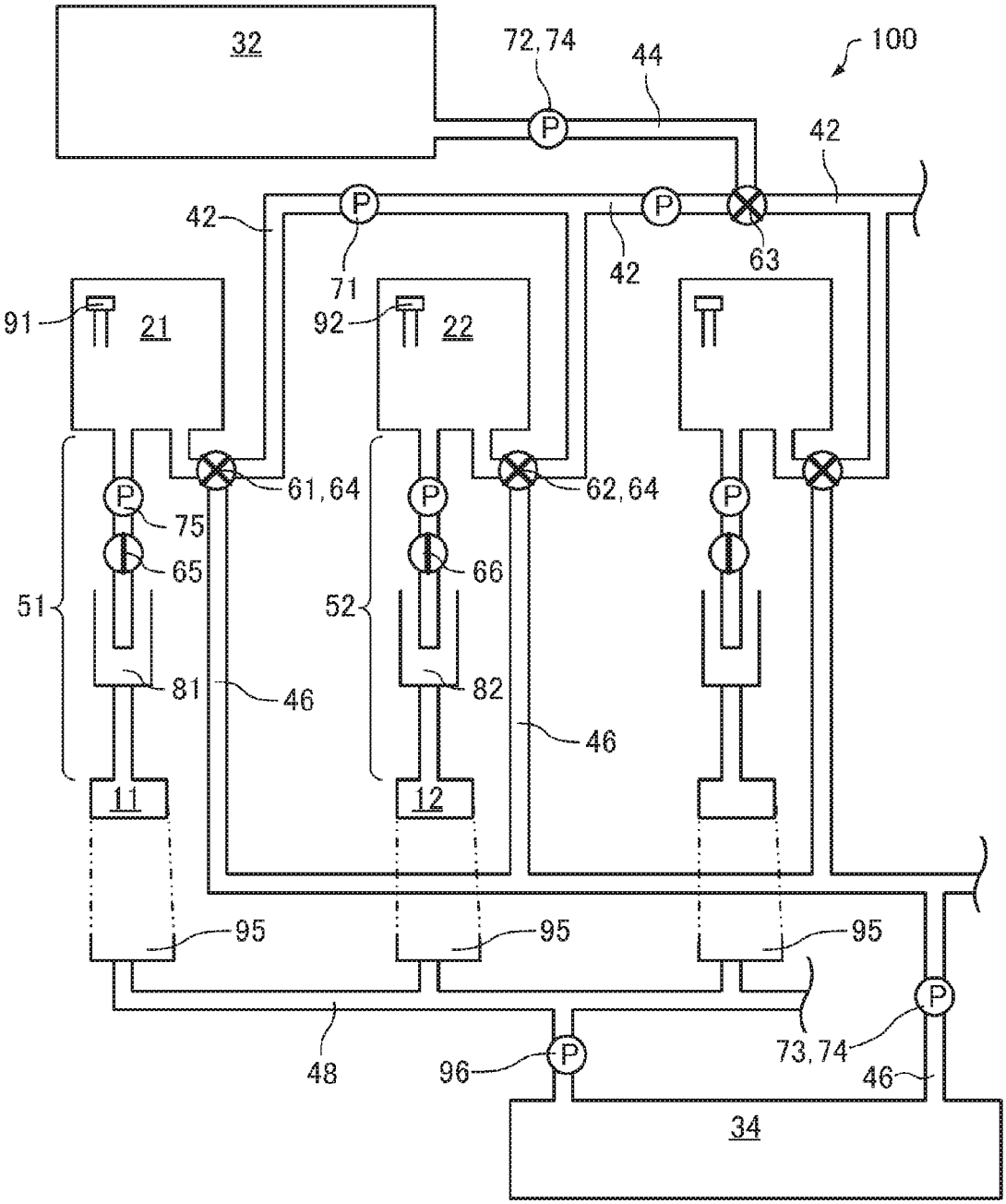
FIG. 1 is a schematic diagram of a main part of a droplet discharge apparatus according to an embodiment.

FIG. 1 is a schematic diagram of a main part of a droplet discharge apparatus 100 according to the embodiment. The droplet discharge apparatus 100 includes a first head 11, a first ink container 21 that stores first ink to be supplied to the first head 11, a second head 12, a second ink container 22 that stores second ink to be supplied to the second head 12, a cleaning liquid container 32 that stores cleaning liquid, a common flow path system 42 that couples the first ink container 21 with the second ink container 22, a cleaning liquid flow path 44 that couples the common flow path system 42 with the cleaning liquid container 32, a first valve 61 that controls a liquid flow rate between the common flow path system 42 and the first ink container 21, a second valve 62 that controls a liquid flow rate between the common flow path system 42 and the second ink container 22, a third valve 63 that controls a liquid flow rate between the common flow path system 42 and the cleaning liquid flow path 44, a first pomp 71 that is provided in the common flow path system 42 and feeds the first ink from the first ink container 21 to the second ink container 22 through the common flow path system 42, a second pomp 72 that feeds the cleaning liquid from the cleaning liquid container 32 to the first ink container 21 through the cleaning liquid flow path 44 and the common flow path system 42, and a control unit not shown in the figures.

The droplet discharge apparatus 100 further includes a first flow path system 51 that couples the first head 11 with the first ink container 21, a first auxiliary container 81 that is coupled to the first head 11, a second flow path system 52 that couples the second head 12 with the second ink container 22, a second auxiliary container 82 that is coupled to the second head 12, a first sensor 91 that detects the amount of liquid in the first ink container 21, a second sensor 92 that detects the amount of liquid in the second ink container 22, a waste liquid container 34, a waste liquid flow path system 46 that couples the common flow path system 42 with the waste liquid container 34, a fourth valve 64 that controls a liquid flow rate between the common flow path system 42 and the waste liquid flow path system 46, a fifth valve 65 provided in the first flow path system 51, a sixth valve 66 provided in the second flow path system 52, a third pomp 73 that feeds the cleaning liquid transferred to the first ink container 21 from the first ink container 21 to the waste liquid container 34 through the common flow path system 42 and the waste liquid flow path system 46, a fourth pomp 74 that feeds the cleaning liquid from the cleaning liquid container 32 to the waste liquid container 34 through the cleaning liquid flow path 44, the common flow path system 42, and the waste liquid flow path system 46, and a fifth pomp 75 provided between the first auxiliary container 81 and the first ink container 21.

The droplet discharge apparatus 100 further includes the first sensor 91 that detects the amount of liquid in the first ink container 21 and the second sensor 92 that detects the amount of liquid in the second ink container 22. The droplet discharge apparatus 100 further includes suction caps 95, which suck liquid in the first head 11 and the second head 12 from nozzles of the first head 11 and the second head 12, respectively. The suction caps 95 are coupled to a suction flow path 48 that depressurizes the insides of the suction caps 95 when the suction caps 95 cap the heads. The suction flow path 48 is provided with a sixth pomp 96. The liquid transferred from the suction caps 95 is configured to be collected to the waste liquid container 34.

1.1. Head

The droplet discharge apparatus 100 has a plurality of heads. The number of heads included in the droplet discharge apparatus 100 may be arbitrary as long as the number is two or more. The head discharges liquid such as ink supplied to the head as droplets from fine nozzles. The droplets discharged from the head is attached to, for example, a recording medium not shown in the figures. Thereby, an image can be recorded on the recording medium, or the recording medium can be printed. A method of the head is not limited, but the method is, for example, a piezoelectric method. These heads may discharge different colors of inks, respectively, or a plurality of heads may discharge the same color of ink.

In the description below, one of the plurality of heads included in the droplet discharge apparatus 100 is referred to as the "first head 11" and one of the heads other than the first head 11 is referred to as the "second head 12".

1.2. Ink and Cleaning Liquid

The ink used in the droplet discharge apparatus 100 is not limited as long as the ink can be discharged as droplets from the head described above. As the types of ink, there are, for example, dye ink, pigment ink, UV ink, and the like. The colors of ink are not particularly limited and may be cyan, magenta, yellow, black, and the like, or may be prepared special colors. The ink may be treatment liquid containing no color material or the like. The ink may contain an organic solvent, a surfactant, and other additive agents, which are commonly used.

In the description below, the ink to be supplied to the first head 11 is referred to as the "first ink", and the ink to be supplied to the second head 12 is referred to as the "second ink". In the present embodiment, as described below, when the first ink container 21 is cleaned, the first ink is transferred to the second ink container 22, so that it is preferable that the first ink and the second ink are the same. By doing so, the second ink stored in the second ink container 22 can be maintained in a predetermined color even when the first ink is mixed in the second ink.

The cleaning liquid can clean the containers, the flow paths, and the like. In the droplet discharge apparatus 100, the cleaning liquid is stored in the cleaning liquid container 32 and is introduced to the common flow path system 42, the first ink container 21, the first head 11, and the like through the cleaning liquid flow path 44 as needed. Thereby, containers and the like through which the cleaning liquid passes are cleaned. The composition of the cleaning liquid is, for example, water or organic solvent, and may contain additive agents such as a surfactant as needed.

In the present specification, at least one of the ink, the cleaning liquid, and a mixture liquid of the ink and the cleaning liquid may be referred to as "liquid".

1.3. Container

The droplet discharge apparatus 100 includes a plurality of ink containers that store ink to be supplied to the head. The number of the ink containers may be the same as the number of the heads. The ink container stores ink and supplies the ink to a corresponding head. When replacing the ink, a predetermined ink is introduced to the ink container after the cleaning liquid is introduced to the ink container and the ink container is cleaned.

In the droplet discharge apparatus 100, the ink container is not configured to be easily removed from the apparatus in such a manner as to remove a so-called cartridge, and is configured so that a color of ink to be discharged from the head is changed by replacing the stored ink. In the droplet discharge apparatus 100, the ink container is a so-called big tank and has a capacity larger than that of the cartridge.

In the description below, the ink container corresponding to the "first head 11" of the plurality of ink containers provided in the droplet discharge apparatus 100 is referred to as the "first ink container 21" and the ink container corresponding to the "second head 12" is referred to as the "second ink container 22".

The droplet discharge apparatus 100 further includes the cleaning liquid container 32 that stores the cleaning liquid and the waste liquid container 34 that stores liquid in addition to the containers described above. The cleaning liquid container 32 stores the cleaning liquid described above. The waste liquid container 34 stores liquid that is no longer required, such as ink, a mixture liquid of ink and cleaning liquid, and cleaning liquid.

The droplet discharge apparatus 100 further includes the first auxiliary container 81 that is coupled to the first head 11 and the second auxiliary container 82 that is coupled to the second head 12. The first auxiliary container 81 and the second auxiliary container 82 are included in the first flow path system 51 and the second flow path system 52, respectively, and stores the first ink and the second ink supplied from the first ink container 21 and the second ink container 22, respectively. Both the first auxiliary container 81 and the second auxiliary container 82 are open type, and thereby the pressures of ink applied to the first head 11 and the second head 12 are adjusted. Further, because of the open type, liquid can be sucked to an end side of the first flow path system 51.

1.4. Flow Path and Flow Path System

The droplet discharge apparatus 100 includes the common flow path system 42 that couples the first ink container 21 with the second ink container 22, the cleaning liquid flow path 44 that couples the common flow path system 42 with the cleaning liquid container 32, the first flow path system 51 that couples the first head 11 with the first ink container 21, the second flow path system 52 that couples the second head 12 with the second ink container 22, and the waste liquid flow path system 46 that couples the common flow path system 42 with the waste liquid container 34.

Each of the first flow path system 51, the second flow path system 52, the common flow path system 42, the cleaning liquid flow path 44, and the waste liquid flow path system 46 is composed of a tube, a pipe, a combination of these, or the like. Each of these flow paths and flow path systems can cause liquid to flow. Arrangement and the like of these flow paths and flow path systems are optional and are not limited as long as they can be coupled in a predetermined manner.

1.5. Valves

The droplet discharge apparatus 100 includes the first valve 61 that controls the liquid flow rate between the common flow path system 42 and the first ink container 21, the second valve 62 that controls the liquid flow rate between the common flow path system 42 and the second ink container 22, the third valve 63 that controls the liquid flow rate between the common flow path system 42 and the cleaning liquid flow path 44, the fourth valve 64 that controls the liquid flow rate between the common flow path system 42 and the waste liquid flow path system 46, the fifth valve 65 provided in the first flow path system 51, and the sixth valve 66 provided in the second flow path system 52.

Each of these valve is a valve or the like. As the valve, any unit that can adjust a flow rate or select a flow path is appropriately used. Examples of the valve that selects a flow path include a three-way cock, a three-way valve, and the like. Although FIG. 1 shows an example in which a three-way cock is used as each valve, one three-way cock may be replaced with a plurality of valves.

The valve can select a flow path and change the magnitude of liquid flow rate and the like based on a signal from the control unit.

1.6. Pomps

The droplet discharge apparatus 100 includes the first pomp 71 that is provided in the common flow path system 42 and feeds the first ink from the first ink container 21 to the second ink container 22 through the common flow path system 42, the second pomp 72 that feeds the cleaning liquid from the cleaning liquid container 32 to the first ink container 21 through the cleaning liquid flow path 44 and the common flow path system 42, the third pomp 73 that feeds the cleaning liquid transferred to the first ink container 21 from the first ink container 21 to the waste liquid container 34 through the common flow path system 42 and the waste liquid flow path system 46, the fourth pomp 74 that feeds the cleaning liquid from the cleaning liquid container 32 to the waste liquid container 34 through the cleaning liquid flow path 44, the common flow path system 42, and the waste liquid flow path system 46, and the fifth pomp 75 provided between the first auxiliary container 81 and the first ink container 21.

A specific example of these pomps is a pump. The type of pump is not particularly limited. A liquid feeding direction of the pump is appropriately designed. A pump whose liquid feeding direction can be selected may be used, and when such a pump is used, the number of the pumps may be reduced. In FIG. 1, a pomp and a valve are provided in one liquid flow passage for explanation. However, the pomp may double as the valve.

The pomp changes a liquid flow rate, a liquid feeding direction, and the like based on a signal from the control unit.

1.7. Other Configurations

The droplet discharge apparatus 100 includes the first sensor 91 that detects the amount of liquid in the first ink container 21 and the second sensor 92 that detects the amount of liquid in the second ink container 22. Signals corresponding to each the amount of liquid detected by each sensor are referred to by the control unit.

The droplet discharge apparatus 100 has suction caps 95, each of which sucks liquid in a head from nozzles of the head. The suction cap 95 is provided corresponding to each head. The suction cap 95 is coupled with the suction flow path 48 that depressurizes the inside of the suction cap 95 when the suction cap 95 caps the head. The suction flow path 48 is provided with the sixth pomp 96 which is configured so that liquid sucked to the suction flow path 48 is transferred to the waste liquid container 34. The liquid transferred from the suction cap 95 may be collected to a container different from the waste liquid container 34.

The droplet discharge apparatus 100 is provided with, for example, a mechanism that relatively moves the head and a recording medium in addition to the configuration described above, so that the droplet discharge apparatus 100 can perform ink jet type recording on the recording medium.

1.8. Control Unit

The droplet discharge apparatus 100 has the control unit not shown in the figures. The valves, the pomps, the caps, the sixth pomp 96, and the like are controlled based on a signal from the control unit. Further, the control unit can acquire a signal from each sensor and control each component based on the acquired signal.

2. Control of Droplet Discharge Apparatus

The droplet discharge apparatus 100 of the present embodiment can easily change the liquid discharged from the head to a different liquid. Hereinafter, an example will be described where the first ink and the second ink are the same ink, the first ink in the first ink container 21 is removed, and the first ink container 21 is cleaned, so that ink different from the first ink and the second ink can be introduced into the first ink container 21.

Figure 2:
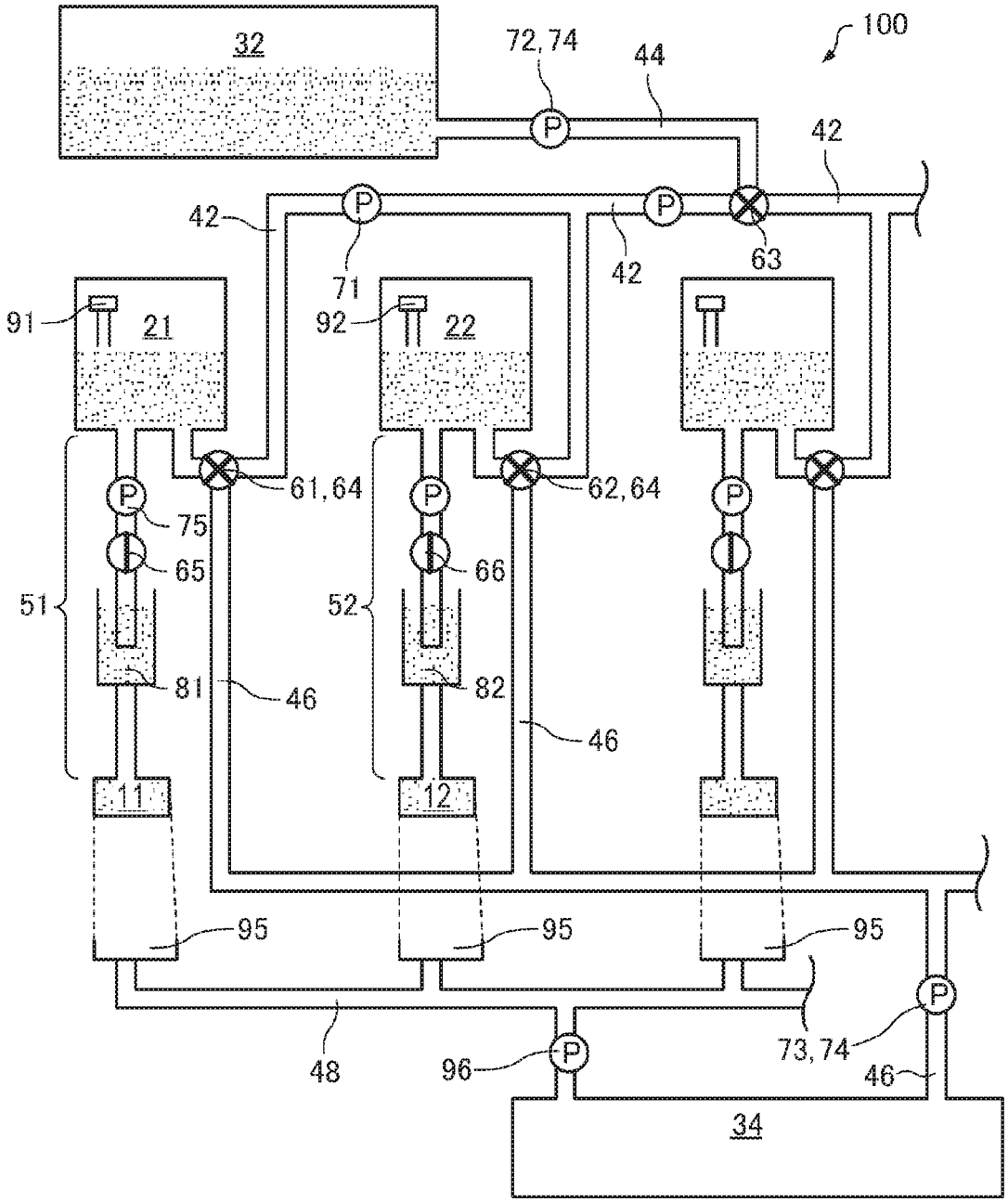
FIG. 2 is a schematic diagram showing a part of a control procedure of the main part of the droplet discharge apparatus according to the embodiment.
Figure 3:
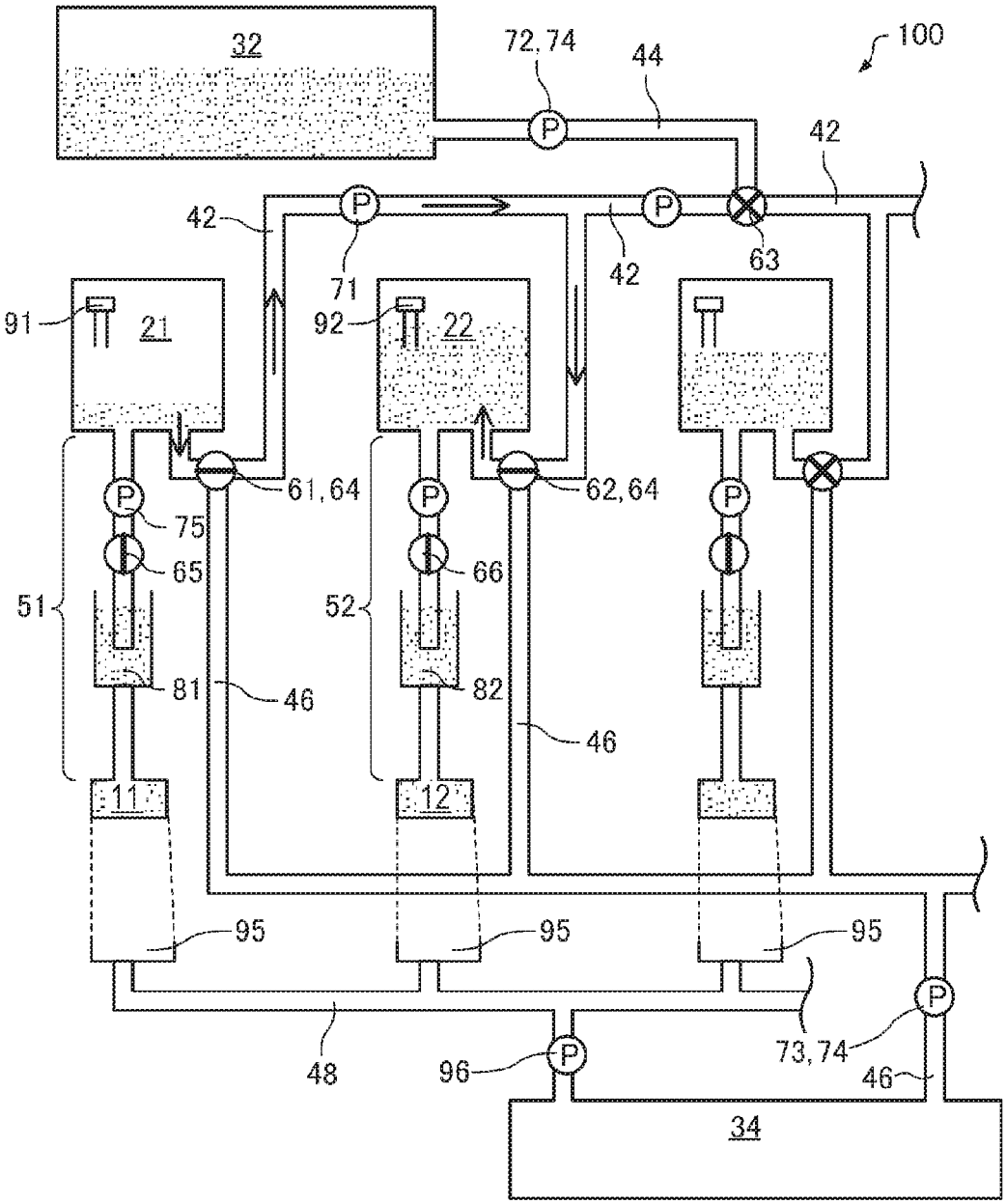
FIG. 3 is a schematic diagram showing a part of the control procedure of the main part of the droplet discharge apparatus according to the embodiment.
Figure 4:
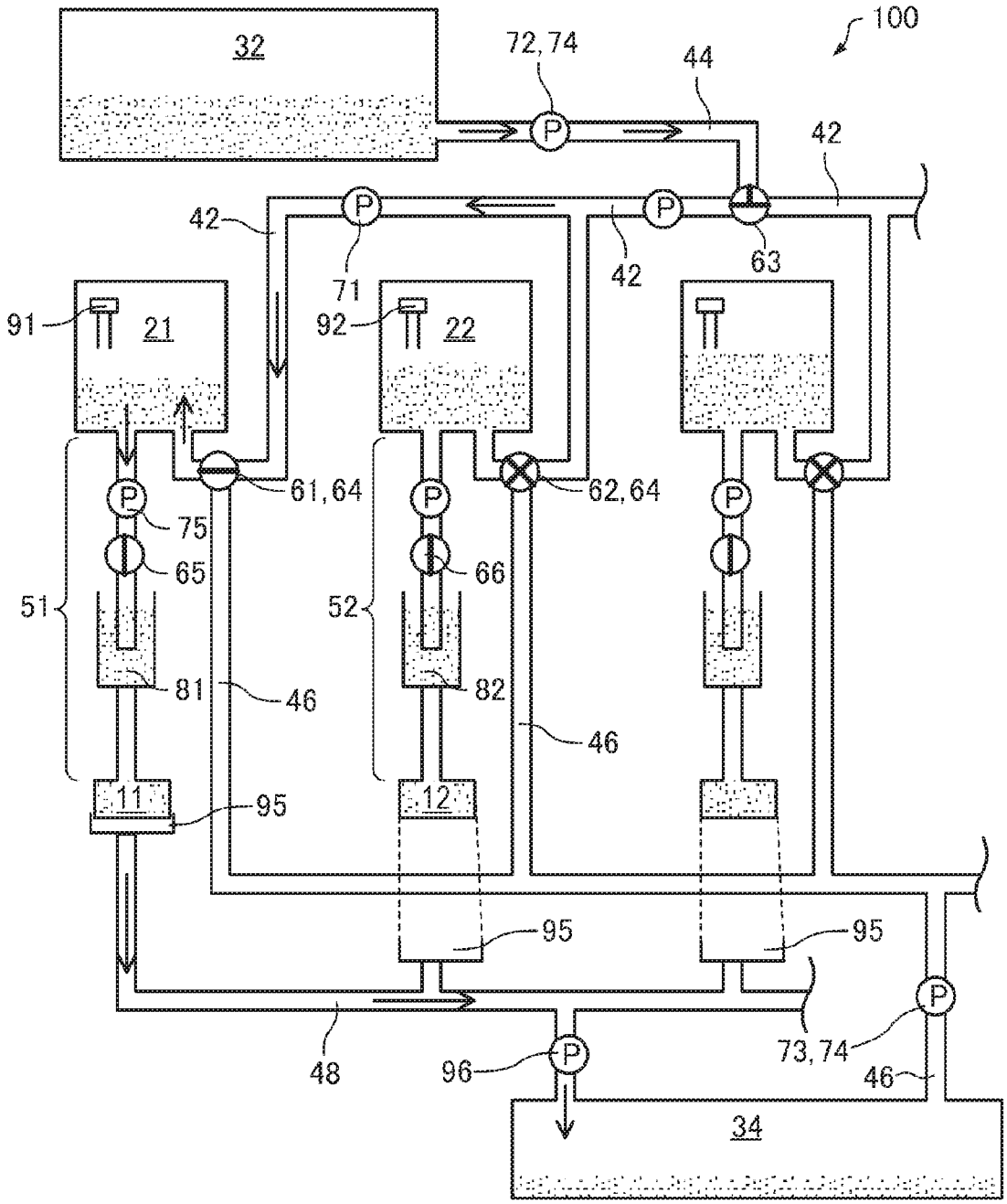
FIG. 4 is a schematic diagram showing a part of the control procedure of the main part of the droplet discharge apparatus according to the embodiment.

FIGS. 2 to 4 are schematic diagrams showing a procedure where the first ink and the second ink are the same ink, the first ink in the first ink container 21 is removed, and the first ink container 21 is cleaned.

FIG. 2 shows a state where the first ink is stored in the first ink container 21, the first ink is discharged from the first head 11, the first ink is stored in the second ink container 22, and the first ink is discharged from the second head 12. FIG. 2 shows three pairs of ink and ink container. An arbitrary ink is discharged from a head of a third pair. There may be four or more pairs of head and ink container.

In FIG. 2, each valve is a valve or a three-way valve, and an arrangement of each valve is indicated by a circular mark. A flow passage of the valve is displayed by a solid line in the circle. Further, when the flow path is closed by a flowing unit, X is displayed in the circle.

First, a procedure in which the cleaning liquid is introduced into the first ink container 21 from a state shown in FIG. 2 will be described. This procedure is performed when the control unit transfers the first ink stored in the first ink container 21 to the second ink container 22 through the common flow path system 42 by controlling the first valve 61, the second valve 62, the third valve 63, and the first pomp 71, and transfers the cleaning liquid stored in the cleaning liquid container 32 to the first ink container 21 through the cleaning liquid flow path 44 and the common flow path system 42 by controlling the first valve 61, the second valve 62, the third valve 63, and the second pomp 72.

Specifically, as shown in FIG. 3, the first ink container 21 and the common flow path system 42 are communicated with each other by the first valve 61, and the second ink container 22 and the common flow path system 42 are communicated with each other by the second valve 62. Thereby, a passage that communicates the first ink container 21, the common flow path system 42, and the second ink container 22 with each other is formed. Then, the first ink is transferred to the second ink container 22 by driving the first pomp 71.

Then, as shown in FIG. 4, the second valve 62 is closed, and the cleaning liquid flow path 44 and the common flow path system 42 are communicated with each other by the third valve 63. Thereby, a passage that communicates the cleaning liquid container 32, the cleaning liquid flow path 44, the common flow path system 42, and the first ink container 21 with each other is formed. Then, the cleaning liquid is transferred to the first ink container 21 by driving the second pomp 72. In the case of this example, the cleaning liquid may be transferred by driving the first pomp 71 instead of the second pomp 72 in a direction opposite to the transfer direction of the first ink.

In this way, the cleaning liquid is introduced into the first ink container 21, and the first ink container 21 can be cleaned. Further, the amount of the first ink to be discarded can be reduced by transferring the first ink to the second ink container 22.

Next, the cleaning liquid in the first ink container 21 is transferred to the first head 11 through the first flow path system 51 by controlling the fifth valve 65. More specifically, as shown in FIG. 4, the fifth valve 65 is opened, the first head 11 is sealed by the suction cap 95, the first flow path system 51 is coupled to the suction flow path 48, and the sixth pomp 96 is driven, so that the cleaning liquid that has cleaned the first ink container 21 is transferred to the waste liquid container 34. Thereby, the cleaning liquid stored in the first ink container 21 passes through the first flow path system 51, so that the cleaning liquid cleans the first flow path system 51. The sixth pomp 96 may be driven after the cleaning liquid is sufficiently stored in the first ink container 21 or may be driven at the same time when the cleaning liquid is introduced into the first ink container 21.

Figure 5:
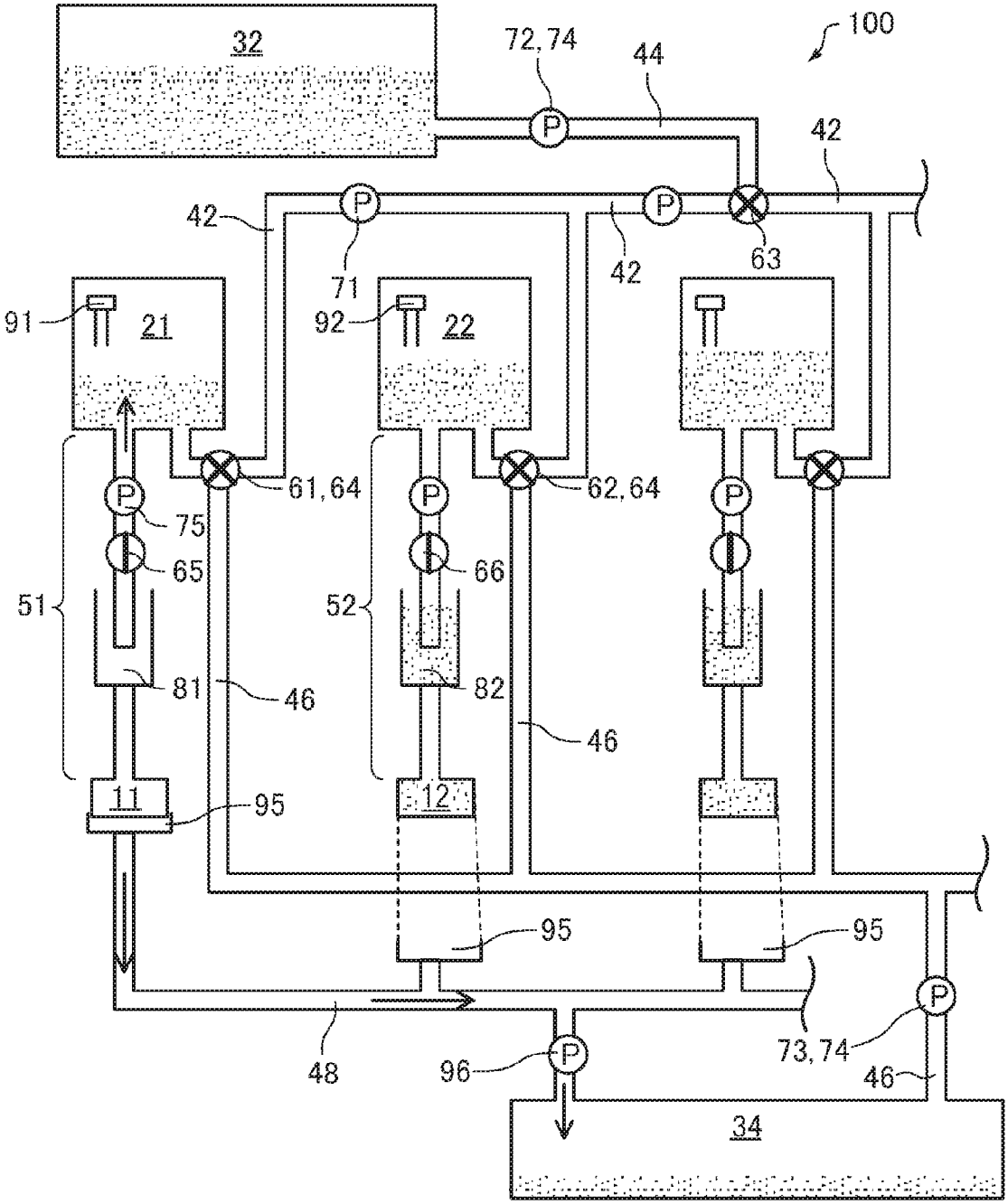
FIG. 5 is a schematic diagram showing a part of the control procedure of the main part of the droplet discharge apparatus according to the embodiment.

On the other hand, as shown in FIG. 5, the first ink in the first flow path system 51 on the first ink container 21 side of the first auxiliary container 81 may be collected to the first ink container 21 by opening the fifth valve 65 and driving the fifth pomp 75 before transferring the first ink from the first ink container 21 to the second ink container 22. By doing so, it is possible to collect the first ink stored in the first auxiliary container 81 and further reduce the amount of the first ink to be discarded.

Figure 6:
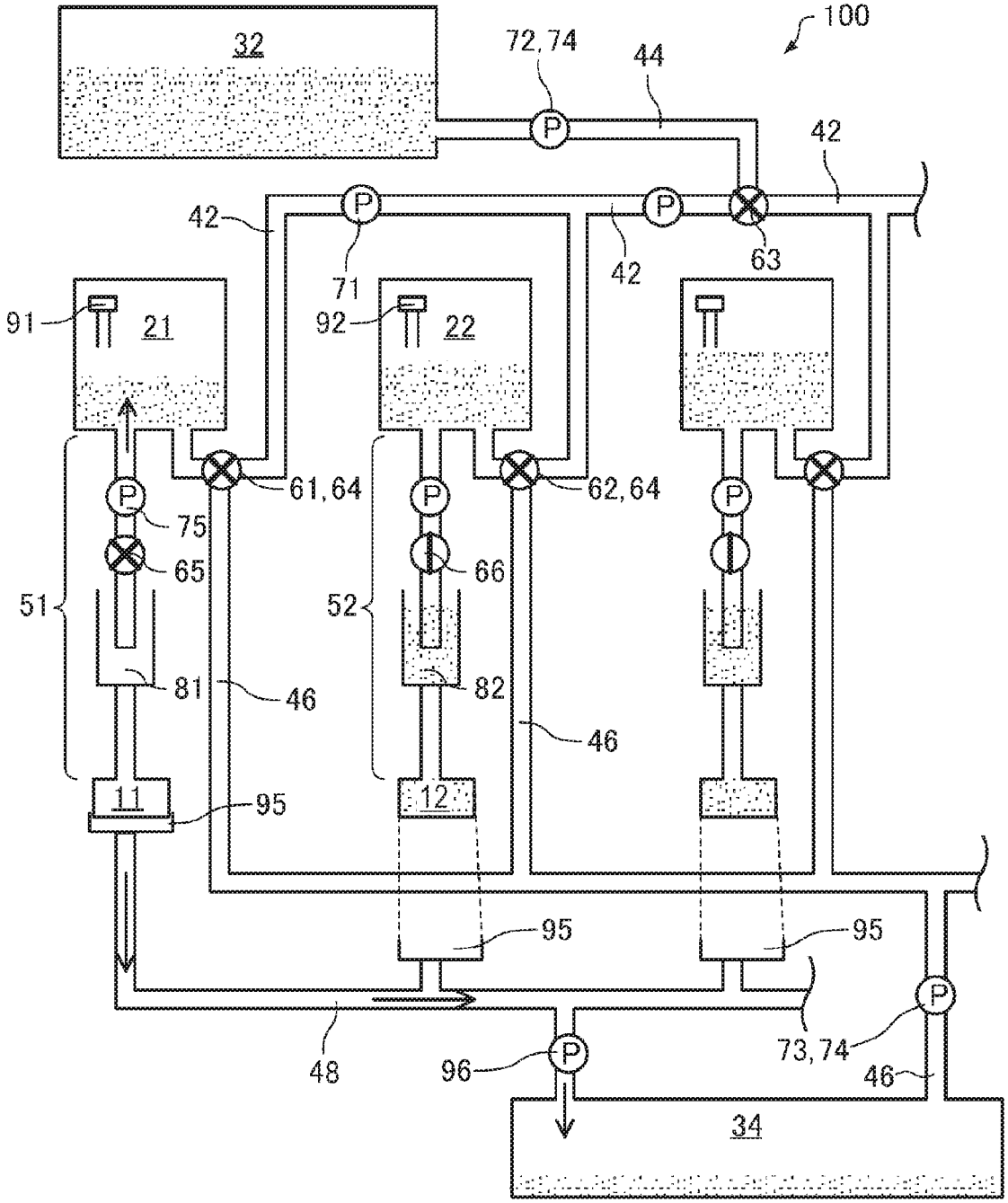
FIG. 6 is a schematic diagram showing a part of the control procedure of the main part of the droplet discharge apparatus according to the embodiment.

Further, as shown in FIG. 6, the first ink in the first auxiliary container 81 and the first head 11 may be transferred to the waste liquid container 34 by closing the fifth valve 65, capping the first head 11 with the suction cap 95, and driving the sixth pomp 96 before transferring the cleaning liquid from the first ink container 21 to the waste liquid container 34. By doing so, it is possible to discard in advance the first ink between the first auxiliary container 81 and the first head 11. Therefore, it is possible to further improve cleaning efficiency when the cleaning liquid passes through the first flow path system 51.

Figure 7:
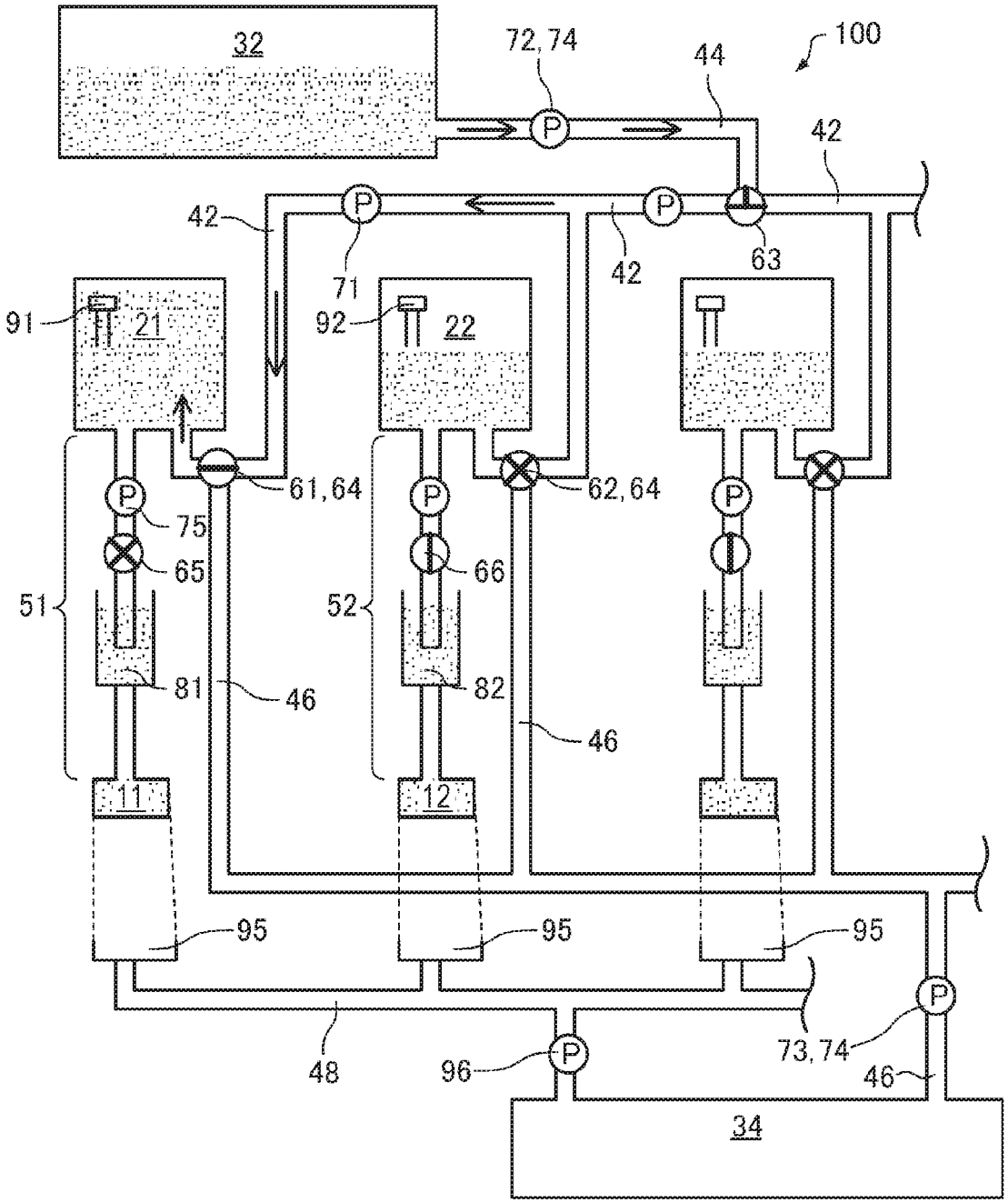
FIG. 7 is a schematic diagram showing a part of the control procedure of the main part of the droplet discharge apparatus according to the embodiment.

Further, as shown in FIG. 7, when the cleaning liquid stored in the cleaning liquid container 32 is transferred to the first ink container 21 through the cleaning liquid flow path 44 and the common flow path system 42, a liquid flow rate of the first flow path system 51 may be reduced by controlling the fifth valve 65. In this case, the fifth valve 65 may be closed. By doing so, a larger amount of the cleaning liquid can be stored in the first ink container 21. Thereby, it is possible to clean the first ink container 21 up to its upper part, so that it is possible to more efficiently clean the first ink container 21.

Figure 8:
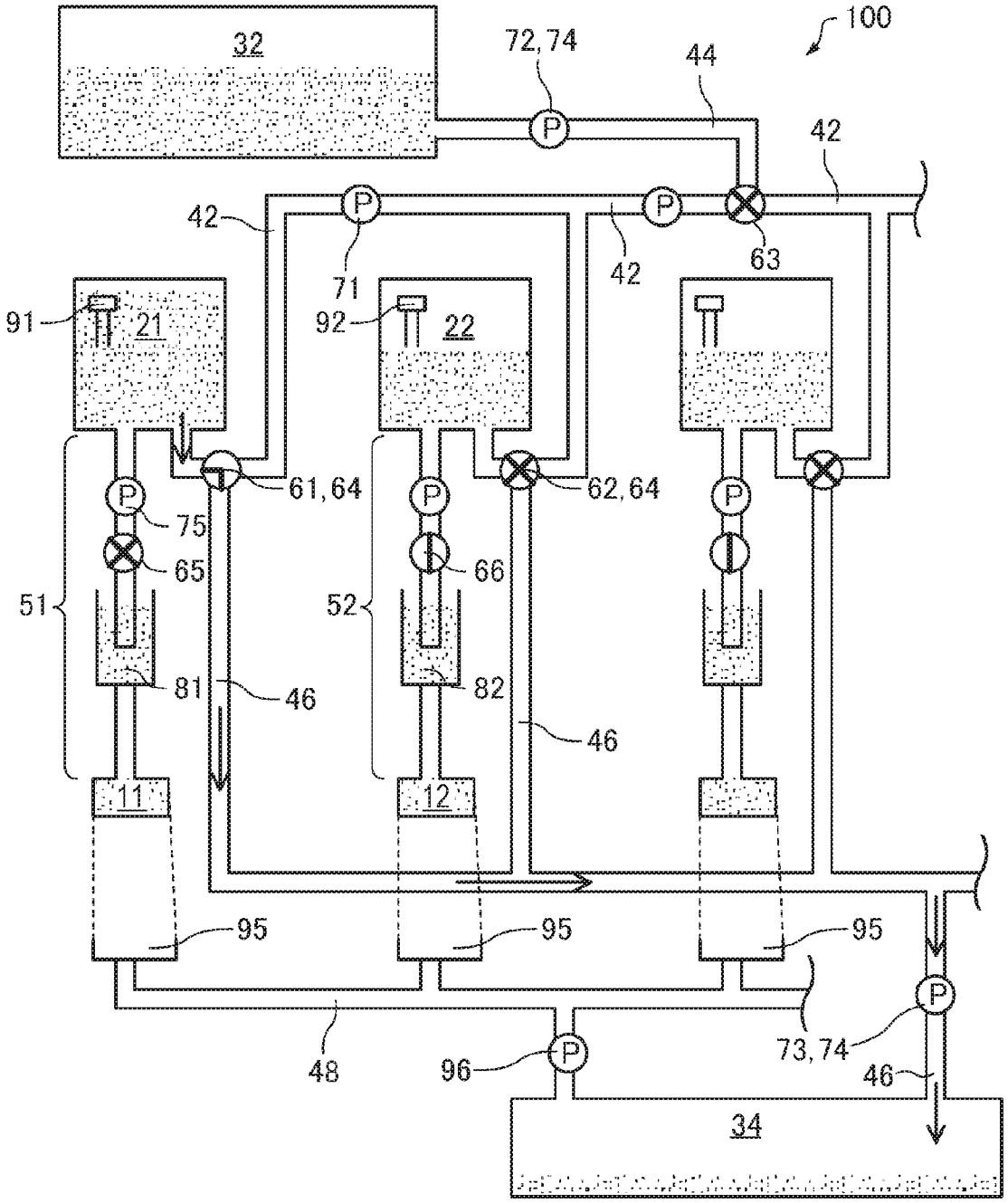
FIG. 8 is a schematic diagram showing a part of the control procedure of the main part of the droplet discharge apparatus according to the embodiment.

The cleaning liquid stored in the first ink container 21 may be transferred to the waste liquid container 34 through a passage other than the first flow path system 51. FIG. 8 shows an example in which the cleaning liquid transferred to the first ink container 21 is transferred to the waste liquid container 34 through the waste liquid flow path system 46 by controlling the first valve 61, the fourth valve 64, and the third pomp 73. As shown in FIG. 8, the cleaning liquid in the first ink container 21 can be transferred to the waste liquid container 34 through the waste liquid flow path system 46 by causing the first valve 61 to communicate the first ink container 21 and the waste liquid flow path system 46 with each other and driving the third pomp 73 provided on the waste liquid flow path system 46.

By doing so, the cleaning liquid in the first ink container 21 can be transferred to the waste liquid container 34 without through the first flow path system 51. Therefore, for example, when a foreign object occurs in the first ink container 21, it is possible to prevent the foreign object from passing through the first head 11. Specifically, in the first head 11, there are flow paths with small flow path diameter such as nozzles, flow path resistance portions, and filters, so that if a foreign object enters into the first head 11, there is a risk of occurrence of clogging. On the other hand, in the configuration described above, the cleaning liquid in the first ink container 21 is transferred to the waste liquid container 34 without through the first flow path system 51. Therefore, it is possible to suppress clogging of the first head 11 even when there is a foreign object.

When the cleaning liquid in the first ink container 21 is transferred to the waste liquid container 34 through the waste liquid flow path system 46, the cleaning liquid may be transferred to the waste liquid container 34 through two passages, which are the waste liquid flow path system 46 and the first flow path system 51, by opening the fifth valve 65. Thereby, it is possible to increase a transfer speed of the cleaning liquid from the first ink container 21 to the waste liquid container 34, so that cleaning time can be shortened.

Figure 9:
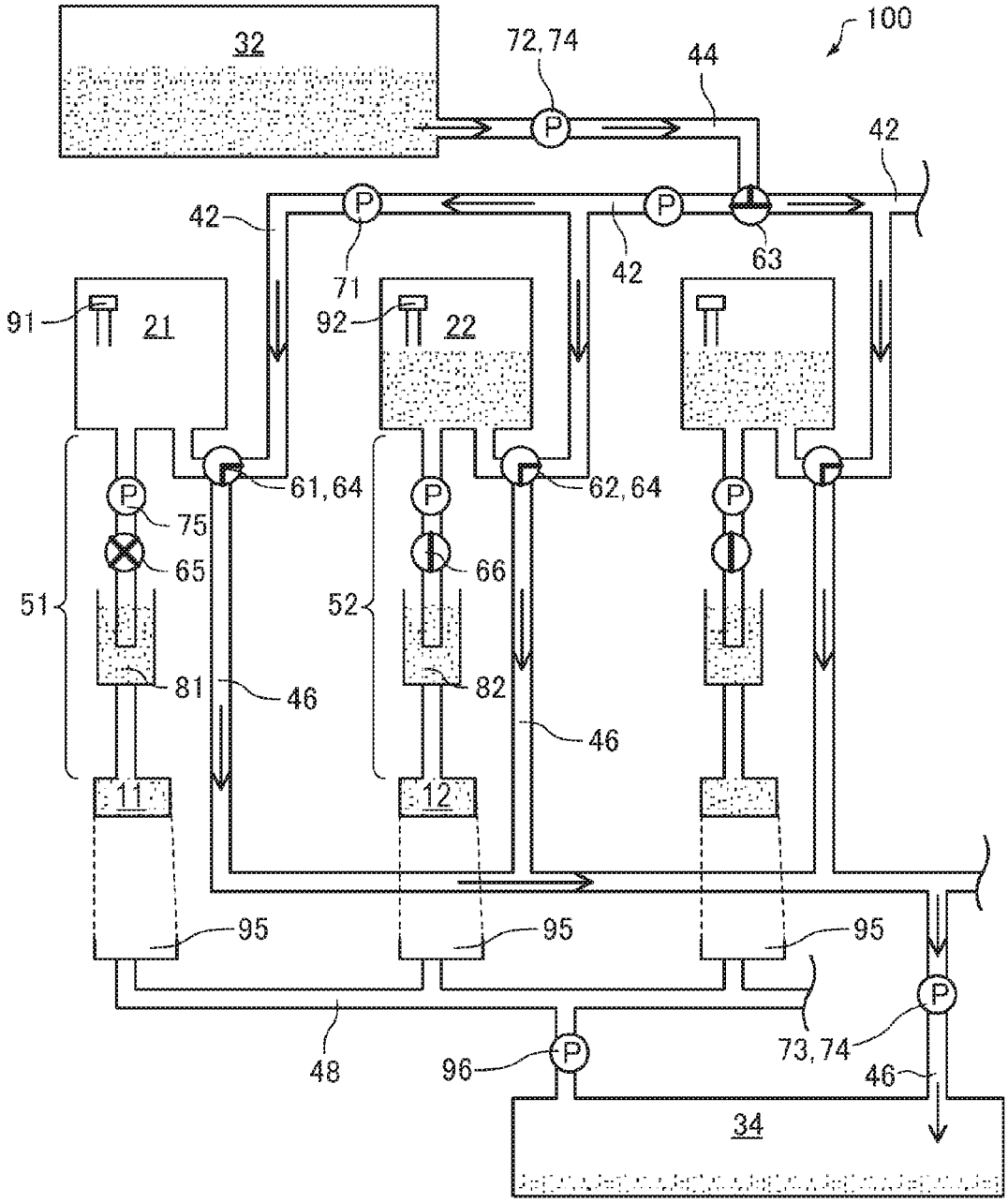
FIG. 9 is a schematic diagram showing a part of the control procedure of the main part of the droplet discharge apparatus according to the embodiment.

As described above, the common flow path system 42 let both the first ink and the cleaning liquid to pass through. Therefore, it is possible to more smoothly perform the next above operation by cleaning the common flow path system 42 with the cleaning liquid. Specifically, the cleaning liquid stored in the cleaning liquid container 32 may be transferred to the waste liquid container 34 through the cleaning liquid flow path 44, the common flow path system 42, and the waste liquid flow path system 46 by controlling the first valve 61, the second valve 62, the third valve 63, the fourth valve 64, and the fourth pomp 74. More specifically, as shown in FIG. 9, the common flow path system 42 and the waste liquid flow path system 46 are communicated with each other by the first valve 61 and the second valve 62, and the cleaning liquid flow path 44 and the common flow path system 42 are communicated with each other by the third valve 63. When the fourth pomp 74 is driven, the cleaning liquid can be transferred to the waste liquid container 34 through the cleaning liquid flow path 44, the common flow path system 42, and the waste liquid flow path system 46.

In the example of FIG. 9, the first valve 61 and the second valve 62 double as the fourth valve 64. These valves may be provided separately from each other. The fourth pomp 74 doubles as the second pomp 72 and the third pomp 73. These pomps may be provided separately from each other. Regarding these fourth pomps 74, it is enough to provide at least one fourth pomp 74. Further, in the example of FIG. 9, a region of the common flow path system 42 other than a region of the common flow path system 42 through which the first ink passes is also cleaned by the above operation. By doing so, it is possible to easily maintain a clean state of the entire common flow path system 42.

In the droplet discharge apparatus 100, the second ink container 22 is provided with the second sensor 92 that detects the amount of liquid inside the second ink container 22. When the first ink is transferred from the first ink container 21 to the second ink container 22, if the second sensor 92 detects that the amount of liquid in the second ink container 22 exceeds a predetermined amount, the second ink in the second ink container 22 may be transferred to the second auxiliary container 82 by opening the sixth valve 66. By doing so, a larger amount of the first ink can be stored in the second ink container 22, so that it is possible to further suppress waste of ink.

In the droplet discharge apparatus 100, the first ink container 21 is provided with the first sensor 91 that detects the amount of liquid inside the first ink container 21. When the total amount of the amount of liquid in the first ink container 21 detected by the first sensor 91 and the amount of liquid in the second ink container 22 detected by the second sensor 92 exceeds the amount of liquid that can be stored in the second ink container 22, the second ink in the second ink container 22 may be transferred to the second auxiliary container 82 by opening the sixth valve 66.

In the droplet discharge apparatus 100, the first auxiliary container 81 is provided with a third sensor not shown in the figures that detects the amount of liquid inside the first auxiliary container 81. When the total amount of the amount of liquid in the first auxiliary container 81 detected by the third sensor and the amount of liquid in the first ink container 21 detected by the first sensor 91 exceeds the amount of liquid that can be stored in the first ink container 21, The droplet discharge apparatus 100 may transfer the first ink from the first ink container 21 to the second ink container 22 before collecting the first ink located in the first flow path system 51 on the first ink container 21 side of the first auxiliary container 81 into the first ink container 21.

When the first sensor detects that the amount of liquid in the first ink container 21 exceeds a predetermined amount while the droplet discharge apparatus 100 collects the first ink located in the first flow path system 51 on the first ink container 21 side of the first auxiliary container 81 into the first ink container 21, the droplet discharge apparatus 100 may start transferring the first ink from the first ink container 21 to the second ink container 22. At a time point when the transfer of the first ink from the first ink container 21 to the second ink container 22 is completed, the first ink located in the first flow path system 51 on the first ink container 21 side of the first auxiliary container 81 may be collected into the first ink container 21 again. Regarding a method of determining whether or not ink remains in the first auxiliary container 81, the third sensor may detect the amount of liquid in the first auxiliary container 81, or it may be determined that ink remains in the first auxiliary container 81 when the first sensor detects that the amount of liquid in the first ink container 21 is increasing.

Further, when the amount of liquid in the first ink container 21 detected by the first sensor 91 is smaller than the amount of liquid in the second ink container 22 detected by the second sensor 92, the first ink stored in the first ink container 21 may be transferred to the second ink container 22 through the common flow path system 42. That is, when the first ink and the second ink are the same ink and another ink is filled into either one of the first ink container 21 and the second ink container 22, any one of the first ink container 21 and the second ink container 22 can be cleaned and emptied by the procedure described above. However, it is preferable to clean and empty the ink container containing less ink between the first ink container 21 and the second ink container 22. By doing so, the amount of transfer of ink between the first ink container 21 and the second ink container 22 can be reduced, so that, for example, it is possible to reduce time to perform the above procedure.

As described above, the droplet discharge apparatus 100 of the present embodiment can suppress waste of ink and easily form an acceptance state for replacing ink. Therefore, when a user replaces ink, it is easy to prepare a cleaned ink container, and desired recording can be performed when the user introduces a desired ink into the ink container.

While a replacing method of ink in the droplet discharge apparatus 100 is described in the present embodiment, an ink system including the first head 11, the second head 12, the first ink container 21, the second ink container 22, the common flow path system 42, the first flow path system 51, and the second flow path system 52 may be attached to and detached from the droplet discharge apparatus. In this case, a cleaning apparatus including the cleaning liquid container 32, the waste liquid container 34, the cleaning liquid flow path 44, the waste liquid flow path system 46, the suction flow path 48, and the suction caps 95 may be attached to and detached from the droplet discharge apparatus. The cleaning apparatus is a different body from the droplet discharge apparatus. The ink system is attached to the cleaning apparatus and performs replacement of ink. By doing so, another ink system can be attached to the droplet discharge apparatus, so that it is not necessary to stop the droplet discharge apparatus for an ink replacement operation.

The present disclosure is not limited to the embodiment described above, but can be variously modified. For example, the present disclosure includes substantially the same configuration as that described in the embodiment, such as, for example, a configuration having the same functions, methods, and results, or a configuration having the same object and effects. Further, the present disclosure includes a configuration in which non-essential portions of the configuration described in the embodiment are replaced. Further, the present disclosure includes a configuration that achieves the same operational effects or can achieve the same object as those of the configuration described in the embodiment. Further, the present disclosure includes a configuration in which a known technique is added to the configuration described in the embodiment.

What is claimed is:

1. A droplet discharge apparatus comprising:

a first head;

a first ink container that stores first ink to be supplied to the first head;

a second head;

a second ink container that stores second ink to be supplied to the second head;

a cleaning liquid container that stores cleaning liquid;

a common flow path system that couples the first ink container with the second ink container;

a cleaning liquid flow path that couples the common flow path system with the cleaning liquid container;

a first valve that controls a liquid flow rate between the common flow path system and the first ink container;

a second valve that controls a liquid flow rate between the common flow path system and the second ink container;

a third valve that controls a liquid flow rate between the common flow path system and the cleaning liquid flow path;

a first pomp that is provided in the common flow path system and feeds the first ink from the first ink container to the second ink container through the common flow path system;

a second pomp that feeds the cleaning liquid from the cleaning liquid container to the first ink container through the cleaning liquid flow path and the common flow path system; and a control unit, wherein the control unit transfers the first ink stored in the first ink container to the second ink container through the common flow path system by controlling the first valve, the second valve, the third valve, and the first pomp, and transfers the cleaning liquid stored in the cleaning liquid container to the first ink container through the cleaning liquid flow path and the common flow path system by controlling the first valve, the second valve, the third valve, and the second pomp.

2. The droplet discharge apparatus according to claim 1, further comprising:

a waste liquid container;

a waste liquid flow path system that couples the common flow path system with the waste liquid container;

a fourth valve that controls a liquid flow rate between the common flow path system and the waste liquid flow path system; and a third pomp that feeds the cleaning liquid transferred to the first ink container from the first ink container to the waste liquid container through the waste liquid flow path system, wherein the control unit transfers the cleaning liquid transferred to the first ink container to the waste liquid container through the waste liquid flow path system by controlling the first valve, the fourth valve, and the third pomp.

3. The droplet discharge apparatus according to claim 2, further comprising:

a fourth pomp that feeds the cleaning liquid from the cleaning liquid container to the waste liquid container through the cleaning liquid flow path, the common flow path system, and the waste liquid flow path system, wherein the control unit transfers the cleaning liquid stored in the cleaning liquid container to the waste liquid container through the cleaning liquid flow path, the common flow path system, and the waste liquid flow path system by controlling the first valve, the second valve, the third valve, the fourth valve, and the fourth pomp.

4. The droplet discharge apparatus according to claim 2, wherein the waste liquid container stores liquid discharged from the first head.

5. The droplet discharge apparatus according to claim 1, further comprising:

a first flow path system that couples the first head with the first ink container; and a fifth valve provided in the first flow path system, wherein the control unit transfers the cleaning liquid transferred to the first ink container to the first head through the first flow path system by controlling the fifth valve.

6. The droplet discharge apparatus according to claim 5, wherein the control unit reduces a liquid flow rate of the first flow path system by controlling the fifth valve when transferring the cleaning liquid stored in the cleaning liquid container to the first ink container through the cleaning liquid flow path and the common flow path system.

7. The droplet discharge apparatus according to claim 5, wherein the first flow path system includes a first auxiliary container coupled to the first head, and a fifth pomp provided between the first auxiliary container and the first ink container, and the control unit collects the first ink stored in the first auxiliary container into the first ink container by controlling the fifth pomp before transferring the first ink stored in the first ink container to the second ink container through the common flow path system.

8. The droplet discharge apparatus according to claim 1, further comprising:

a second flow path system that couples the second head with the second ink container;

a sixth valve provided in the second flow path system;

a first sensor that detects an amount of liquid in the first ink container;

a second sensor that detects an amount of liquid in the second ink container; and a second auxiliary container coupled to the second head, wherein the control unit transfers the second ink in the second ink container to the second auxiliary container by controlling the sixth valve when a total amount of the amount of liquid in the first ink container detected by the first sensor and the amount of liquid in the second ink container detected by the second sensor exceeds a predetermined amount before transferring the first ink stored in the first ink container to the second ink container through the common flow path system.

9. The droplet discharge apparatus according to claim 1, further comprising:

a second flow path system that couples the second head with the second ink container;

a sixth valve provided in the second flow path system;

a second sensor that detects an amount of liquid in the second ink container; and a second auxiliary container coupled to the second head, wherein the control unit transfers the second ink in the second ink container to the second auxiliary container by controlling the sixth valve when the second sensor detects that the amount of liquid in the second ink container exceeds a predetermined amount.

10. The droplet discharge apparatus according to claim 1, further comprising:

a first sensor that detects an amount of liquid in the first ink container; and a second sensor that detects an amount of liquid in the second ink container, wherein the control unit transfers the first ink stored in the first ink container to the second ink container through the common flow path system when the amount of liquid in the first ink container detected by the first sensor is smaller than the amount of liquid in the second ink container detected by the second sensor.

11. The droplet discharge apparatus according to claim 1, wherein the first ink and the second ink are the same ink.

* * * * *